United States Patent [19]

Matsuyama, Glen

[11] 4,085,841

[45] Apr. 25, 1978

[54] CARTON ASSEMBLY

[75] Inventor: Matsuyama, Glen, Los Angeles, Calif.

[73] Assignee: Graphic Arts Packaging Corporation, Gardena, Calif.

[21] Appl. No.: 792,202

[22] Filed: Apr. 29, 1977

[51] Int. Cl.[2] ..... B65D 5/50

[52] U.S. Cl. ..... 206/45.15; 206/44.12; 206/45.13; 206/385; 206/804; 229/19; 229/44 CB

[58] Field of Search ..... 206/216, 44.12, 45.13, 206/45.14, 45.15, 45.29, 45.3, 385, 804; 221/229, 247, 249; 229/9, 11, 19, 20, 44 CB

[56] References Cited

U.S. PATENT DOCUMENTS

| | | | |
|---|---|---|---|
| 1,928,759 | 10/1933 | McQuillen | 206/250 |
| 1,957,293 | 5/1934 | Reilly | 206/250 |
| 2,597,810 | 5/1952 | Myers | 206/45.13 |
| 3,311,283 | 3/1967 | Shimada et al. | 229/44 CB |
| 3,561,762 | 2/1971 | Russell | 206/45.3 |
| 3,589,505 | 6/1971 | Burniski | 206/248 |
| 3,823,864 | 7/1974 | Ohkubo | 206/45.14 |
| 3,899,125 | 8/1975 | Andrews et al. | 229/44 CB |

FOREIGN PATENT DOCUMENTS

| | | | |
|---|---|---|---|
| 419,951 | 3/1967 | Sweden | 229/44 CB |
| 388,971 | 3/1933 | United Kingdom | 229/20 |

*Primary Examiner*—Stephen P. Garbe
*Assistant Examiner*—Bruce H. Bernstein
*Attorney, Agent, or Firm*—Keith D. Beecher

[57] ABSTRACT

A carton assembly is provided which may be formed of pasteboard, or other suitable material, and which is particularly useful for packaging and displaying articles such as containers for perfumes, lipsticks and the like. The carton assembly of the invention comprises an outer shell of rectangular cross-section having a top cover hinged to one edge of the upper end of the shell by a scoreline, and the shell has an open bottom; and the carton assembly also comprises an insert of rectangular cross-section which is slidable in the shell, and which is suspended from a top flap; the top flap being hinged to the outer edge of the top cover by a further scoreline. The insert has an open front so that the article may be displayed when the insert is moved to an open position in which its upper portion protrudes through the top end of the shell. The upper end of the insert is open, so that the article may be removed from the carton when the insert is in its open position. When the insert is moved back into the shell it draws the top cover of the shell down with it to a closed position across the top of the shell.

6 Claims, 5 Drawing Figures

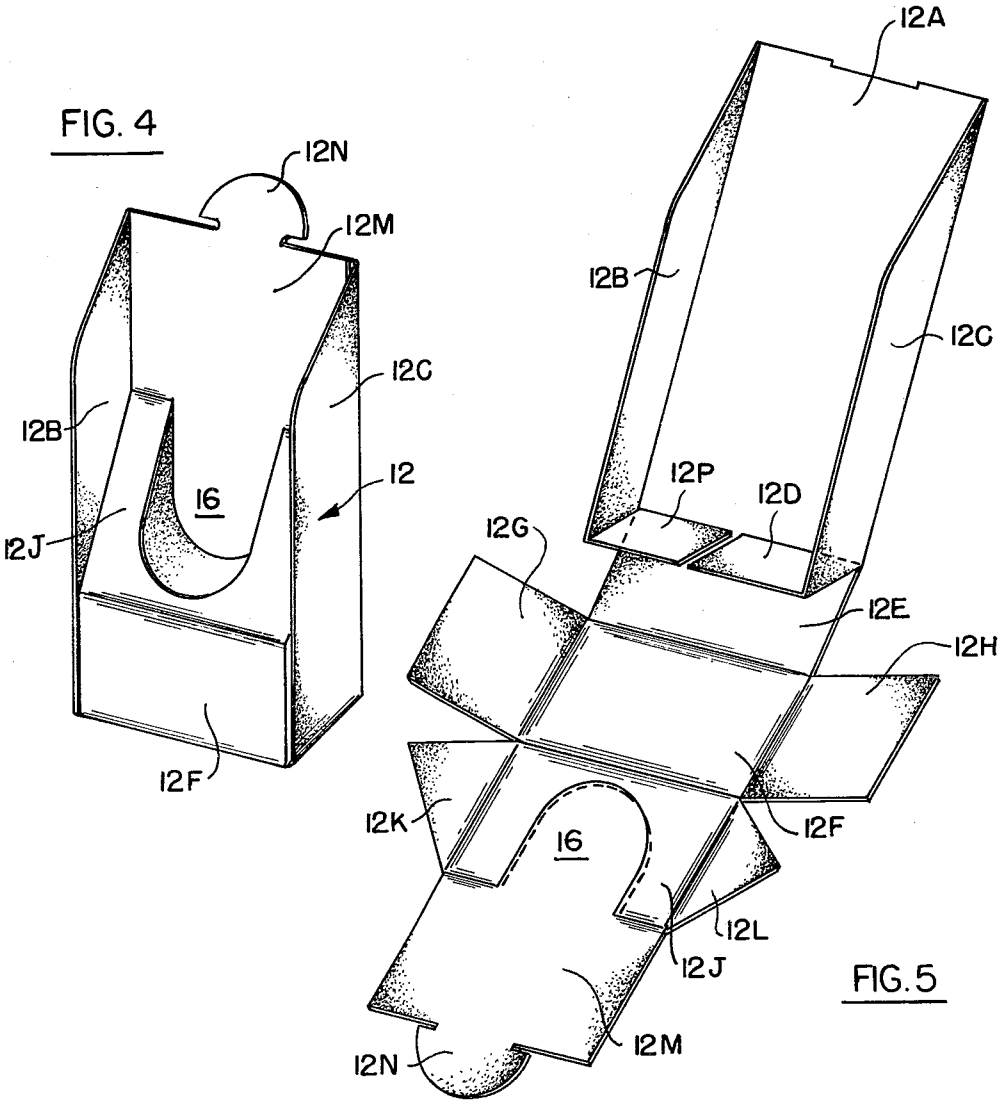
FIG. 5
FIG. 4
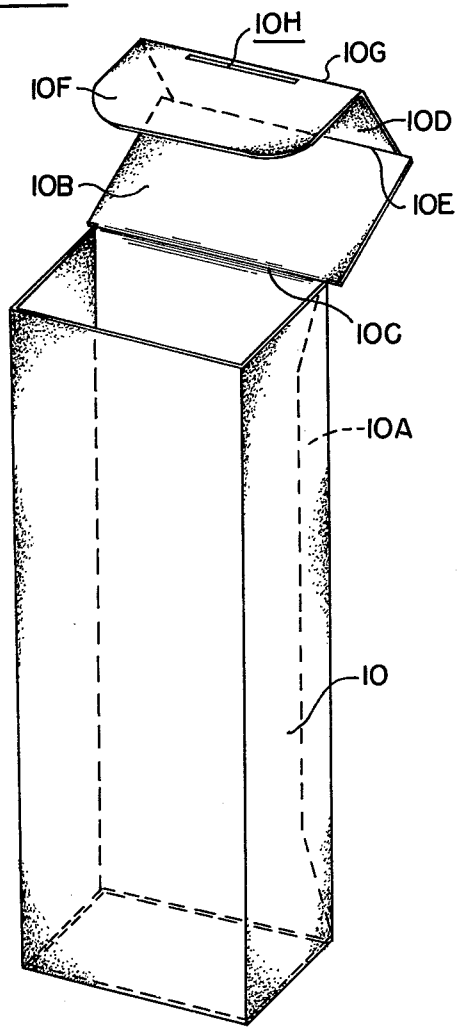
FIG. 3

CARTON ASSEMBLY

BACKGROUND OF THE INVENTION

An important objective of the invention is to provide a carton assembly of the type described above, and for the purpose described above, which is relatively inexpensive to fabricate, which is sturdy in its construction, which is simple to load and unload, and which includes an insert which may be moved to a position in which the article contained therein may be displayed.

BRIEF DESCRIPTION OF THE DRAWNINGS

FIG. 3 is a perspective view of an outer shell which forms one component of the carton assembly of FIGS. 1 and 2;

FIG. 4 is a perspective view of an insert, which forms a second component of the carton assembly of FIGS. 1 and 2; and FIG. 5 is a perspective view of the insert of FIG. 4 in a partially folded condition.

DETAILED DESCRIPTION OF THE ILLUSTRATED EMBODIMENT

Figure 2:
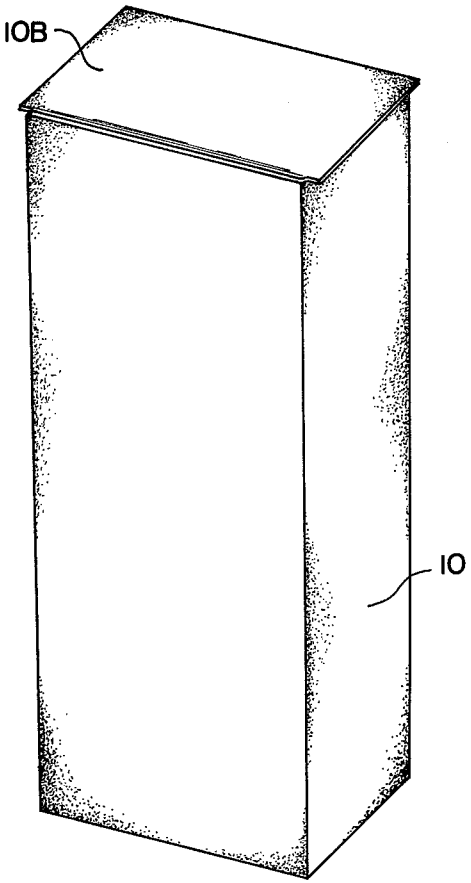
FIG. 2 is a perspective representation of the carton assembly of FIG. 1 in a closed position.

The carton assembly of the invention is formed of pasteboard, or the like, and it comprises two components, namely an outer shell 10 of retangular cross-section, such as shown in FIG. 3; and an insert 12, likewise of rectangular cross-section, and which is slidable in the shell 10. The shell 10, and the insert 12, are each formed by folding a single piece of pasteboard into a desired configuration, and by gluing mating flaps together, so as to hold the resulting unit in an assembled condition.

For example, the outer shell 10 is formed by folding a single piece of pasteboard about appropriate scorelines to form an open-ended member of rectangular cross-section, with the member being held assembled by means of an internal flap 10A which is integral with one of the sides of the resulting unit, and which is glued to an adjacent side.

A cover 10B for the shell 10 is formed integral with the rear edge of the upper end of the shell, and is hinged to the edge by means of an appropriate scoreline 10C. The length of the cover 10B is slightly longer than the width of the upper end of the shell 10, so that when the cover is closed down over the top end of the shell, it is supported across the top end.

A flap 10D is formed integral with the outer edge of cover 10B, and is hinged to the outer edge of the cover 10B by an appropriate scoreline 10E. The flap 10D has approximately the same dimensions as the cover 10B, but has a slightly shorter length, so that it may extend down into the shell 10 when the cover 10B is pulled down to a closed position.

A second flap 10F is formed integral with the outer edge of flap 10D, and it is shaped as shown. Flap 10F is hinged to flap 10D by an appropriate scoreline 10G. A slot 10H is formed in the scoreline 10E and extends partially along the length of the scoreline.

The insert 12 is slidable in the shell 10, as mentioned above. The insert is formed to have a rear wall panel 12A (FIG. 5), and to have two side panels 12B formed integral with the rear wall and extending outwardly from the plane of the rear wall. The side panels 12B define an open front for the insert, so that the product 50 (FIG. 1) may be displayed when the insert is moved to its open position of FIG. 1; and the side panels also define an open top, so that the product may be removed from the carton when the assembly is in its open position shown in FIG. 1.

As shown in FIG. 5, a pair of flaps 12C and 12D are formed on the respective lower edges of the sides 12C, and are turned inwardly. A flap 12E is formed integral with the lower edge of the rear wall panel 12A, and extends across the flaps 12C and 12D to constitute a bottom for the insert. The flaps 12C and 12D are glued to the flap 12E to hold the insert in an assembled condition.

A further panel 12F is formed integral with the forward edge of the bottom flap 12E, and a pair of side panels 12G and 12H are formed integral with the panel 12F. The panel 12F is turned up to form the front wall of the insert as shown in FIG. 4, and the panels 12G and 14H extend adjacent to the inner surfaces of the respective side wall panels 12B, and are glued to the side wall panels.

A further panel 12J is formed integral with the upper edge of panel 12F, and the latter panel is folded into an inclined configuration, as shown in FIG. 4 to form a pedestal for the product 50. A slot 16 is formed in the panel 12J for receiving the product. A pair of side flaps 12K and 12L are formed integral with the side edges of panel 12J and form gussets for supporting the pedestal, the side flaps also being glued to the inner surfaces of the respective side wall panels 12B.

A further panel 12M is formed integral with the outer edge of panel 12J, and the latter panel extends adjacent to the rear wall 12A to the top of the insert. A tab 12N is formed integral with the outer edge of panel 12M, the tab being received in the slot 10H in FIG. 2.

The carton assembly described above is constructed so that when the assembly is in the closed condition of FIG. 2, the insert 12 is suspended within shell 10 by the tab 12N. To open the assembly, the insert is pushed up through the open bottom of the shell to the open position shown in FIG. 1.

Figure 1:
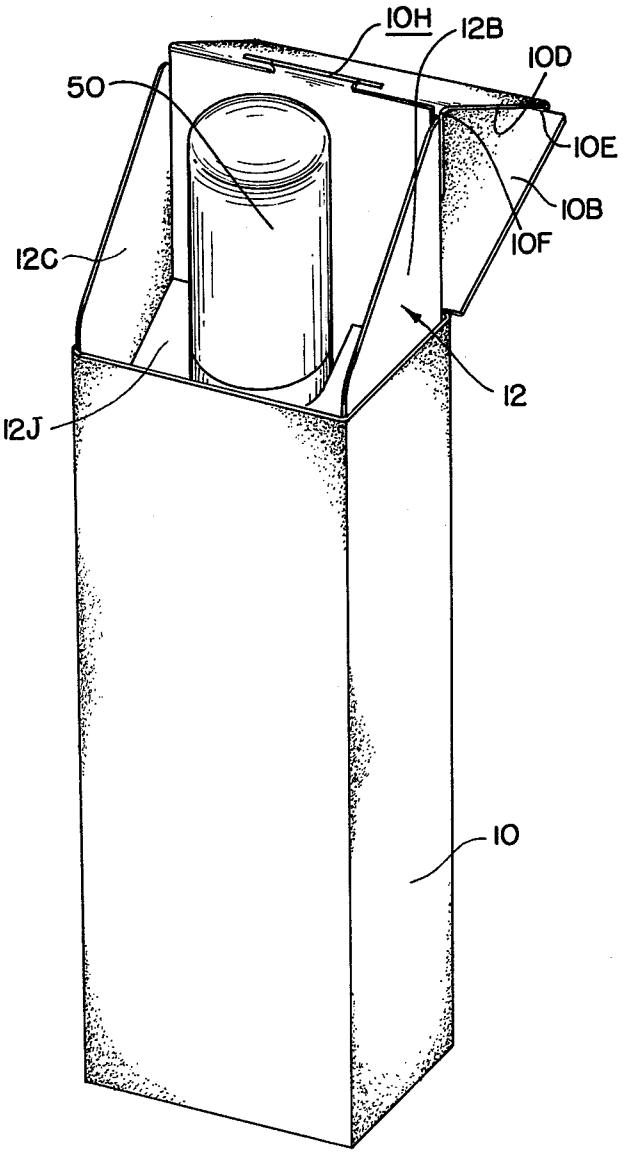
FIG. 1 is a perspective representation showing a carton assembly, constructed in accordance with one embodiment of the invention, in an open condition.

As the insert is pushed to its open position, the cover 10B and flaps 10D and 10F are moved in an accordion-like manner to assume the position shown in FIG. 1, in which the insert is supported so that the product may be displayed through its open front. The product may be easily removed through the open top of the insert. When the insert is moved back into the shell 10, it draws the flaps 10F and 10D back into the shell, which, in turn, draw the cover 10B down to its closed position of FIG. 2.

While a particular embodiment of the invention has been shown and described, modifications may be made. It is intended in the following claims to cover all the modifications which come within the true spirit and scope of the invention.

What is claimed is:

1. A carton assembly comprising: a hollow shell having a rectangular cross-section, a rectangular cover hinged by a scoreline to the rear edge of the upper end of the shell, a first flap hinged by a scoreline to the outer edge of the cover, and a second flap hinged by a scoreline to the outer edge of the first flap, the first and second flaps having a slot therein extending partially along said last-named scoreline; and a hollow insert having a rectangular cross-section slidable in said shell, said insert having a rear wall panel and further having a tab integral with the upper edge of the said insert and extending into said slot to couple the insert to the junction of the first and second flaps with the second flap being positioned against the rear wall panel of the insert and turning with respect to the first flap as the insert is moved within the shell.

2. The carton assembly defined in claim 1, in which said shell has an open bottom.

3. The carton assembly defined in claim 1, in which said cover has a length slightly greater than the width of said shell to enable said cover flap to be supported across the upper end of said shell.

4. The carton assembly defined in claim 1, in which said insert has a folded-over lower portion forming a bottom for the insert, forming a pedestal for supporting a product within the insert, and also forming a further panel integral with the edge of the pedestal and extending upwardly adjacent the inner surface of said rear wall panel to the top of said insert, and with said tab being formed integral with the upper edge of said further panel.

5. The carton assembly defined in claim 4, in which said pedestal has a sloping top with an opening therein for receiving the product.

6. The carton assembly defined in claim 4, in which said insert has an open front to permit the product to be displayed when the insert is pushed in said shell to an open position in which the upper portion of the insert protrudes out through the top of the shell, and in which said insert also has an open top to permit the product to be removed from the insert when the insert is in said open position.

* * * * *